US011263903B2

(12) United States Patent
Kazuno

(10) Patent No.: US 11,263,903 B2
(45) Date of Patent: Mar. 1, 2022

(54) INFORMATION PROVISION SYSTEM

(71) Applicant: HONDA MOTOR CO., LTD., Tokyo (JP)

(72) Inventor: Shuichi Kazuno, Saitama (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 17/182,251

(22) Filed: Feb. 23, 2021

(65) Prior Publication Data

US 2021/0272455 A1 Sep. 2, 2021

(30) Foreign Application Priority Data

Feb. 28, 2020 (JP) ..... JP2020-033457

(51) Int. Cl.
*G08G 1/0968* (2006.01)
*G08B 17/117* (2006.01)
*G08B 17/12* (2006.01)

(52) U.S. Cl.
CPC ..... *G08G 1/096811* (2013.01); *G08B 17/117* (2013.01); *G08B 17/125* (2013.01)

(58) Field of Classification Search
CPC ..... G01J 5/0066; G06K 9/3233; E05F 15/72; E05F 1/006; G08B 17/125
See application file for complete search history.

(56) References Cited

U.S. PATENT DOCUMENTS

2010/0097474 A1* 4/2010 Zhao ..... H04N 5/23229 348/169
2016/0110618 A1* 4/2016 Oba ..... G06K 9/6215 348/148
2020/0086152 A1* 3/2020 Stadler ..... A62C 3/07
2021/0049789 A1* 2/2021 Bonn ..... G06K 9/6293
2021/0069534 A1* 3/2021 Shin ..... A62C 37/38

FOREIGN PATENT DOCUMENTS

JP 2002190084 A 7/2002

* cited by examiner

*Primary Examiner* — Mirza F Alam
(74) *Attorney, Agent, or Firm* — CKC & Partners Co., LLC

(57) ABSTRACT

Provided is an information provision system capable of reducing secondary damage in the case of a disaster. The information provision system includes: a vehicle; and an information provision apparatus communicatively connected to the vehicle and configured to provide information to the vehicle. The information provision apparatus includes an acquirer that acquires fire-related information indicating information about fire, a fire detector that detects an occurrence of fire based on the fire-related information, and a fire information generator that generates, in response to the detection of the occurrence of fire by the fire detector, fire avoidance information for avoiding the fire, and transmits the fire avoidance information to the vehicle. The vehicle includes an information receiver that receives the fire avoidance information, and a display controller that causes a display to display the fire avoidance information.

5 Claims, 5 Drawing Sheets

INFORMATION PROVISION SYSTEM

This application is based on and claims the benefit of priority from Japanese Patent Application No. 2020-033457, filed on 28 Feb. 2020, the content of which is incorporated herein by reference.

BACKGROUND OF THE INVENTION

Field of the Invention

The present invention relates to an information provision system.

Related Art

There have been electric vehicles and fuel cell vehicles equipped with a driving motor. Secondary batteries or hydrogen, which are the drive power for these vehicles, are prone to be damaged by disasters such as fire. In view of this, a technique for evacuating a vehicle from disasters such as fire has been proposed (see, for example, Patent Document 1).

Patent Document 1: Japanese Unexamined Patent Application, Publication No. 2002-190084

SUMMARY OF THE INVENTION

Due to the spread of electric vehicles, fuel cell vehicles, and similar vehicles that are equipped with a driving motor, it is predicted that an increased number of these types of vehicles will experience disasters such as fire in the future. Therefore, it has been desired to detect the occurrence of a disaster without delay and to notify the disaster to vehicles on roads so that secondary damage of the disaster is avoided. In view of the foregoing background, it is an object, of the present invention to provide an information provision system that can reduce secondary damage in the case of a disaster.

One embodiment of the present invention is directed to an information provision system (e.g., an information provision system 1 to be described later) including a vehicle (e.g., a vehicle 100 to be described later); and an information provision apparatus (e.g., an information provision apparatus 200 to be described later) communicatively connected to the vehicle and configured to provide information to the vehicle. The information provision apparatus includes an acquirer (e.g., an acquirer 211 to be described later) that acquires fire-related information indicating information about fire, a fire detector (e.g., a fire detector 212 to be described later) that detects an occurrence of fire based on the fire-related information, and a fire information generator (e.g., a fire information generator 213 to be described later) that generates, in response to the detection of the occurrence of fire by the fire detector, fire avoidance information for avoiding the fire, and transmits the fire avoidance information to the vehicle. The vehicle includes an information receiver (e.g., an information receiver 611 to be described later) that receives the fire avoidance information, and a display controller (e.g., a display controller 613 to be described later) that causes a display to display the fire avoidance information.

The information provision system may further include a monitoring apparatus (e.g., a monitoring apparatus 300 to be described later) communicatively connected to the information provision apparatus and configured to collect information about fire, wherein the fire-related information is transmitted from the monitoring apparatus.

The vehicle may further include a fire sensor (e.g., a fire sensor 90 to be described later) that detects a predetermined physical quantity related to fire. The acquirer may acquire information detected by the fire sensor as the fire-related information.

The fire sensor may include a flame sensor capable of detecting a specific wavelength in an emission spectrum arising from flames.

The fire sensor may include a camera, a temperature sensor, a hydrogen sensor, or a $CO_2$ sensor.

The present invention provides an information provision system that can reduce secondary damage in the case of a disaster.

DETAILED DESCRIPTION OF THE INVENTION

Figure 1:
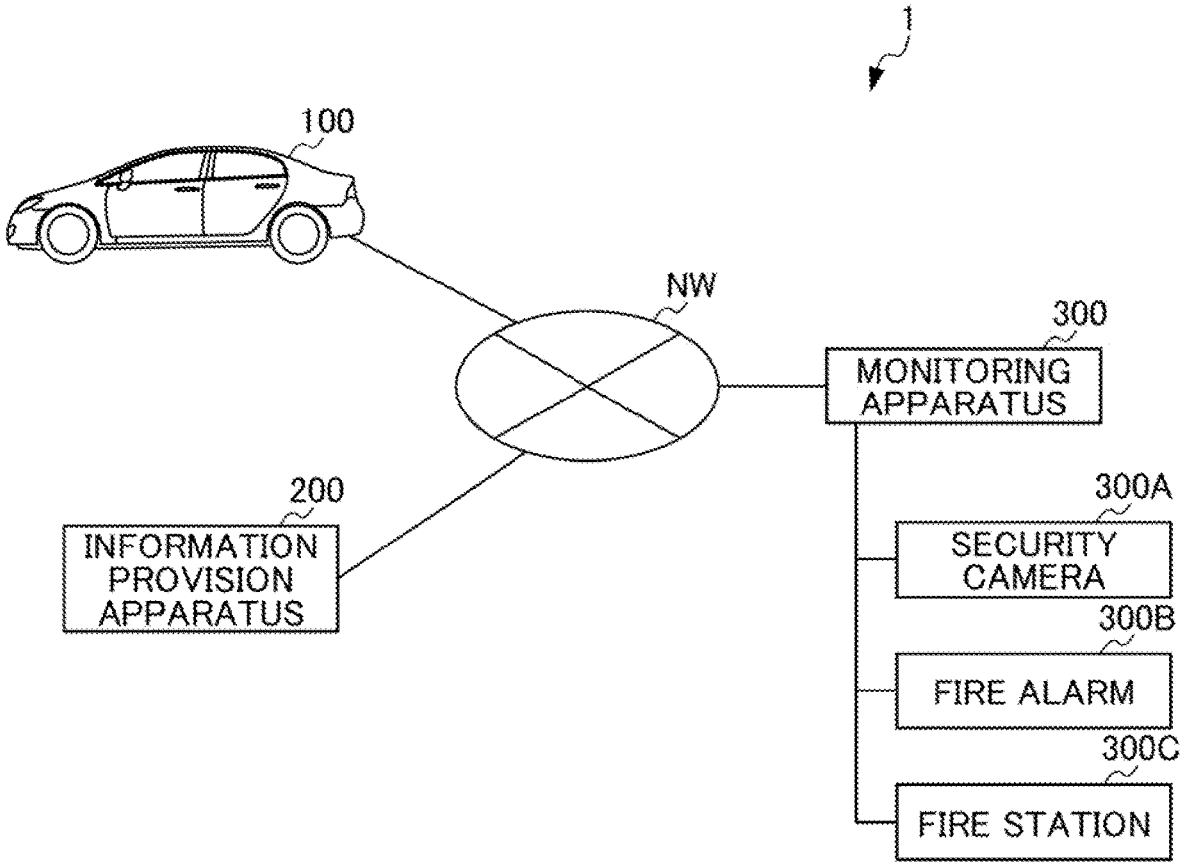
FIG. 1 is a diagram showing an example of a configuration of an information provision system according to an embodiment.

An embodiment of an information provision system of the present invention will be described with reference to the drawings. FIG. 1 is a diagram showing an example of a configuration of the information provision system 1 according to the present embodiment. As shown in FIG. 1, the information provision system 1 includes a vehicle 100, an information provision apparatus 200, and a monitoring apparatus 300.

For example, the vehicle 100 is an electric vehicle. The present embodiment will be described based on the assumption that the vehicle 100 is an electric vehicle. However, the vehicle 100 only needs to be equipped with a battery that supplies electric power to allow the vehicle 100 to run, and may be a hybrid vehicle or a fuel cell vehicle.

The information provision apparatus 200 is communicatively connected to the vehicle 100 and the monitoring apparatus 300 via a network NW. The information provision apparatus 200 detects the occurrence of fire based on fire-related information transmitted from the vehicle 100, the monitoring apparatus 300, etc., and notifies the vehicle 100 of the occurrence of fire.

The monitoring apparatus 300 is communicatively connected to the information provision apparatus 200 via the network NW, and collects information about fire. For example, the monitoring apparatus 300 is connected to a security camera 300A, a fire alarm 300B, and a fire station 300C, and collects information about fire. The monitoring apparatus 300 then transmits the collected fire-related information to the information provision apparatus 200 via the network NW.

Figure 2:
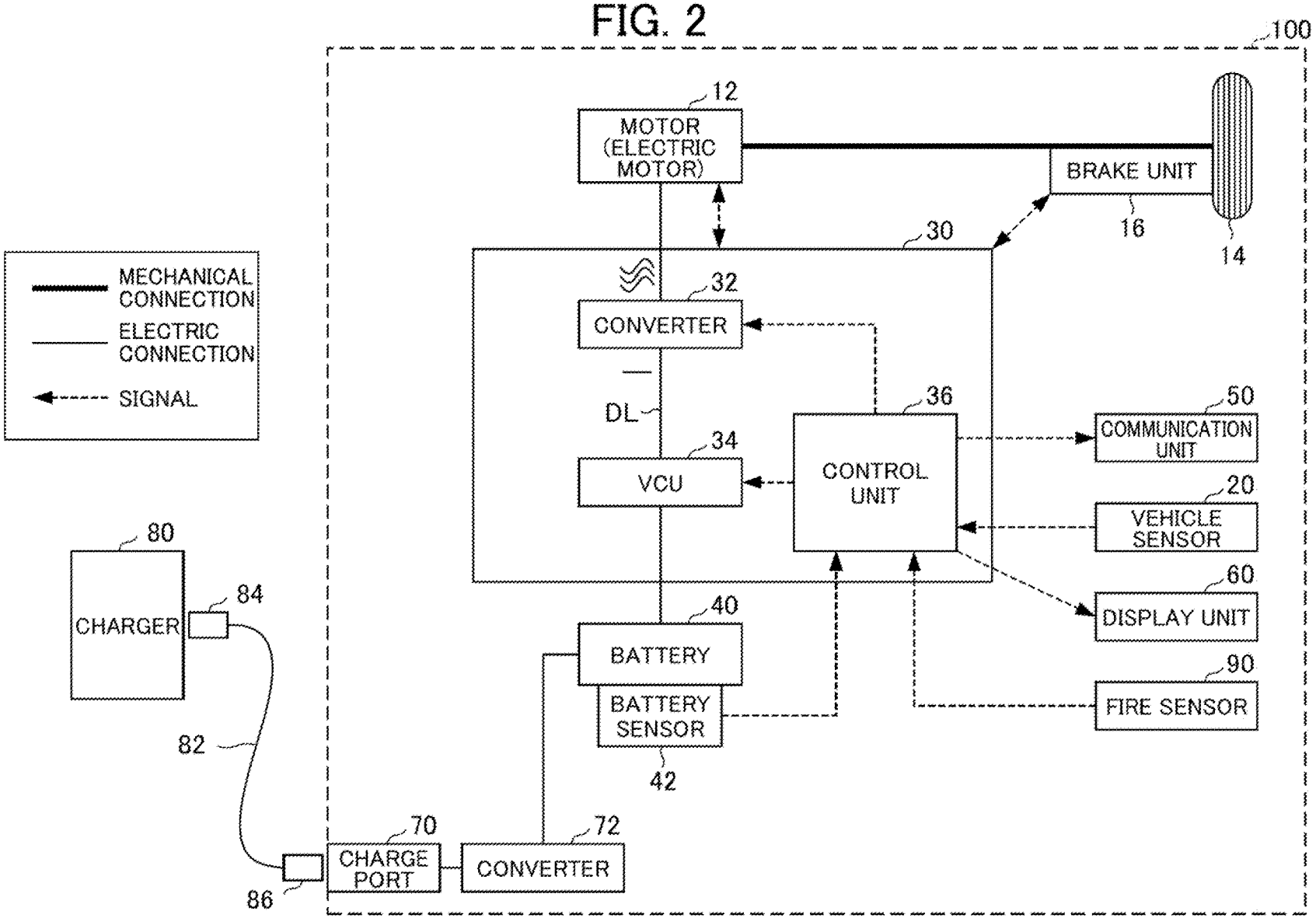
FIG. 2 is a diagram showing an example of a configuration of a vehicle.

Next, the configuration of the vehicle 100 according to an embodiment of the present invention will be described. FIG. 2 is a diagram showing an example of the configuration of the vehicle 100. As shown in FIG. 2, the vehicle 100 includes, for example, a motor 12, drive wheels 14, a brake unit 16, a vehicle sensor 20, a power control unit (PCU) 30, a battery (secondary battery) 40, a battery sensor 42 including a voltage sensor, a current sensor, a temperature sensor, etc., a communication unit 50, a display unit 60, a charge port 70, a converter 72, and a fire sensor 90.

The motor 12 is a three-phase motor, for example. The rotor of the motor 12 is coupled to the drive wheels 14. The motor 12 is supplied with electricity, and outputs drive power to the drive wheels 14 using the electricity. When the vehicle 100 decelerates, the motor 12 generates electricity using the kinetic energy of the vehicle 100.

The brake unit 16 includes, for example, a brake caliper, a cylinder that transmits hydraulic pressure to the brake caliper, and an electric motor that causes the cylinder to generate a hydraulic pressure. The brake unit 16 may include a mechanism for transmitting hydraulic pressure, which is generated when a brake pedal is operated, to the cylinder via a master cylinder, as a backup. The brake unit 16 is not limited to this configuration, and may be an electronically controlled hydraulic brake unit for transmitting a hydraulic pressure of the master cylinder to the cylinder.

The vehicle sensor 20 includes an accelerator opening degree sensor, a vehicle speed sensor, and a brake pedal depression amount sensor. The accelerator opening degree sensor is attached to an accelerator pedal, which is an example of controls for receiving an acceleration command from a driver. The accelerator opening degree sensor detects an operation amount of the accelerator pedal, and outputs the detected operation amount as an opening degree of the accelerator to a control unit 36 of the PCU 30 and the display unit 60. The vehicle speed sensor includes, for example, wheel speed sensors attached to the wheels, and a speed calculator. The vehicle speed sensor derives a speed of the vehicle (vehicle speed) by integrating the wheel speeds detected by the wheel speed sensors, and outputs the speed to the control unit 36 and the display unit 60. The brake pedal depression amount sensor is attached to a brake pedal, detects an operation amount of the brake pedal, and outputs the operation amount of the brake to the control unit 36 and the display unit 60.

The PCU 30 includes, for example, a converter 32, a voltage control unit (VCU) 34, and the control unit 36. These components are integrated into a single unit, i.e., the PCU 30. However, this is a non-limiting example. These components may be arranged in a distributed manner.

The converter 32 is an AC-JDC converter, for example. The converter 32 has a direct current-side terminal connected to a direct current link DL. The direct current link DL is connected to the battery 40 via the VCU 34. The converter 32 converts an alternating current generated by the motor 12 to a direct current, and outputs the direct current to the direct current link DL.

The VCU 34 is a DC-DC converter, for example. The VCU 34 Increases a voltage of the power supplied from the battery 40, and outputs the power to the direct current link DL.

The control unit 36 includes, for example, a motor controller, a brake controller, and a battery-VCU controller. The motor controller, the brake controller, and the battery-VCU controller may be replaced respectively with a motor ECU, a brake ECU, and a battery ECU, which are control units separate from each other.

The motor controller controls the motor 12 based on an output from the vehicle sensor 20. The brake controller controls the brake unit 16 based on an output from the vehicle sensor 20. The battery-VCU controller calculates a state of charge (SOC; a charge rate) of the battery 40 based on an output from the battery sensor 42 attached to the battery 40, and outputs the SOC to the VCU 34. The VCU 34 increases a voltage of the direct current link DL in response to a command from the battery-VCU controller.

The battery 40 is a secondary battery, such as a lithium ion battery. The battery 40 stores electric power sent from a charger 80 that is provided outside the vehicle 100, and discharges the electric power to allow the vehicle 100 to run. The battery sensor 42 includes, for example, the current sensor, the voltage sensor, and the temperature sensor. The battery sensor 42 detects a value of current, a value of voltage, and a temperature of the battery 40. The battery sensor 42 outputs the detected value of current, the detected value of voltage, and the detected temperature to the control unit 36 and the communication unit 50.

The communication unit 50 includes a wireless module for establishing connection with a cellular network and a Wi-Fi network. The communication unit 50 communicates with the information provision apparatus 200 and other apparatuses via the network NW shown in FIG. 1. The display unit 60 displays information of various types, and performs predetermined functions. Components constituting the display unit 60 will be described later.

The charge port 70 is provided to face the outside of the body of the vehicle 100. The charge port 70 is connectable to the charger 80 via an outlet cable 82. The outlet cable 82 includes a first plug 84 and a second plug 86. The first plug 84 is connected to the charger 80 whereas the second plug 86 is connected to the charge port 70. Electricity from the charger 80 is supplied to the charge port 70 via the outlet cable 82.

The outlet cable 82 includes a power cable and a signal cable attached to the power cable. The signal cable allows communication to be established between the vehicle 100 and the charger 80. Thus, the first plug 84 and the second plug 86 are each provided with a power connector and a signal connector.

The converter 72 is provided between the battery 40 and the charge port 70. The converter 72 coverts a current sent from the charger 80 via the charge port 70. For example, the converter 72 converts an alternating current to a direct current. The converter 72 outputs the converted direct current to the battery 40.

Figure 3:
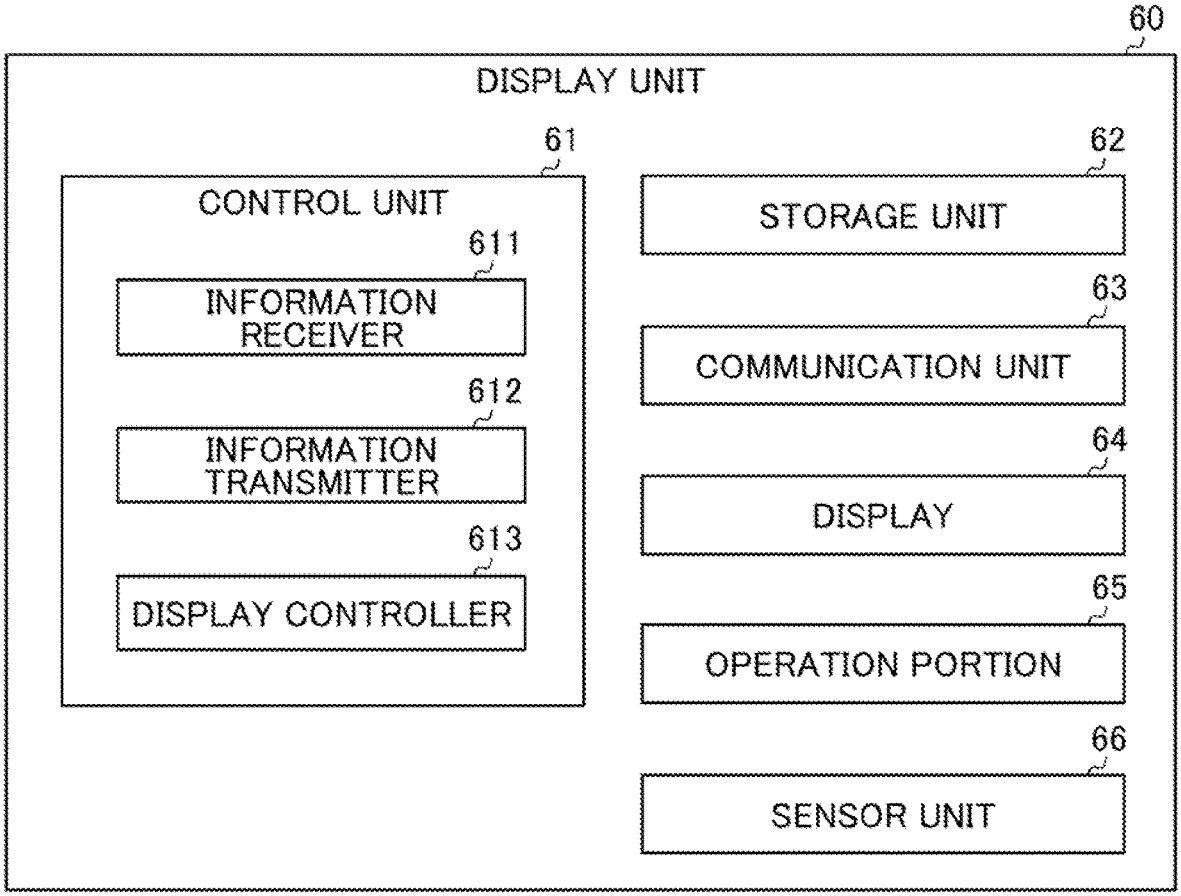
FIG. 3 is a diagram showing an example of a configuration of a display unit.

FIG. 3 is a diagram showing an example of a configuration of the display unit 60. The display unit 60 includes a control unit 61, a storage unit 62, a communication unit 63, a display 64, an operation portion 65, and a sensor unit 66. The control unit 61 is implemented by a hardware processor, such as a central processing unit (CPU), executing programs (software). Part of or all of these components may be implemented by hardware (including circuitry) such as a large scale integration (LSI), an application specific integrated circuit (ASIC), a field-programmable gate array (FPGA), and a graphics processing unit (GPU), or by cooperation between software and hardware. The programs may be stored in advance in a storage device (which is provided with a non-transitory storage medium), such as a hard disk drive (HDD) or a flash memory. Alternatively, the programs may be stored in a removable storage medium (non-transitory storage medium), such as a DVD or a CD-ROM, and may be installed by way of fitting the removable storage medium into a drive device.

The storage unit 62 is implemented by, for example, a storage device including a non-transitory storage medium, such as a hard disk drive (HDD), a flash memory, an electrically erasable programmable read only memory (EE- PROM), and a read only memory (ROM). Alternatively, the storage unit 62 is Implemented by random access memory (RAM) or the like. The storage unit 62 stores, for example, map information, position information, etc.

The communication unit 63 is a communication interface for communicating with external equipment such as the information provision apparatus 200. The communication unit 63 includes, for example, a telematics communication unit (TCU) that is a communication unit dedicated to onboard use, and can transmit and receive signals to and from the network NW and the like.

The display 64 is a device for displaying images. The display 64 is, for example, a liquid crystal display (LCD) or an organic electroluminescence (EL) display. The operation portion 65 includes buttons and the like for operating the display 64. The display 64 and the operation portion 65 may be combined into a touch panel having their functions integrated therein. In this case, the operation portion 65 may be a graphical user interface (GUI) switch displayed on the display 64. Alternatively, the operation portion 65 may be configured as mechanical buttons.

A display screen of an information terminal used by a driver may be used as a substitution for the display 64. Examples of the information terminal include a smart phone, a tablet, a notebook PC, and a video game console. Such information terminal used by the driver is put on a cradle provided on an instrument panel of the vehicle 100 or in the vicinity of the instrument panel, so that the information terminal can display the same information as that displayed on the display 64 mounted on the instrument panel.

The sensor unit 66 includes, for example, a global positioning system (GPS) sensor, a gyro sensor, etc. The sensor unit 66 may additionally include other sensors such as a magnetic field sensor and an acceleration sensor. The sensor unit 66 has a function of detecting position information. The sensor unit 66 receives a GPS satellite signal using the GPS sensor and determines the position information (latitude and longitude) of the vehicle 100. The sensor unit 66 performs the position measurement in a predetermined time cycle (e.g., every three seconds). The information determined by way of the position measurement is stored in the storage unit 62 as the position information.

The fire sensor 90 detects a predetermined physical quantity related to fire. The fire sensor 90 may be, for example, a flame sensor, capable of detecting a specific wavelength in an emission spectrum arising from flames. The flame sensor detects, for example, a wavelength of an UV component in the emission spectrum arising from flames. Alternatively, the fire sensor 90 may include a temperature sensor, a hydrogen sensor, or a $CO_2$ sensor. The temperature sensor detects heat generated by fire. In a case where the vehicle 100 is equipped with a hydrogen fuel cell, the hydrogen sensor detects a concentration of hydrogen leaking from the fuel cell and being likely to cause a fire. The $CO_2$ sensor detects a concentration of $CO_2$ emitted due to the occurrence of fire. The fire sensor 90 detects the predetermined physical quantity and transmits the detected information to the control unit 61.

The fire sensor 90 may be configured as an onboard camera mounted at a predetermined position on the vehicle 100. In this case, the camera captures images of the surroundings of the vehicle 100, and transmits the captured images to the control unit 61.

The control unit 61 communicates with the information provision apparatus 200 by means of the communication unit 63, in response to operation by a user. The control unit 61 transmits a request by the user to the information provision apparatus 200, and provides a push notification based on information received from the information provision apparatus 200. Further, the control unit 61 causes the display 64 to display information provided by the information provision apparatus 200.

Next, processing performed by the control unit 61 will be described. As shown in FIG. 3, the control unit 61 includes an information receiver 611, an information transmitter 612, and a display controller 613. The information receiver 611 receives fire avoidance information transmitted from the information provision apparatus 200. The fire avoidance information includes position information of the location of fire, detour information for going around the location of the fire, information indicating the scale of the fire, etc.

The information transmitter 612 transmits fire-related information that indicates information about fire detected by the fire sensor 90 to the information provision apparatus 200. The display controller 613 causes the display 64 to display the fire avoidance information received by the information receiver 611. Accordingly, if the vehicle 100 is headed for the location of the fire, the user of the vehicle 100 can avoid the location of the fire based on the fire avoidance information displayed on the display 64, or take a detour to go a destination.

Figure 4:
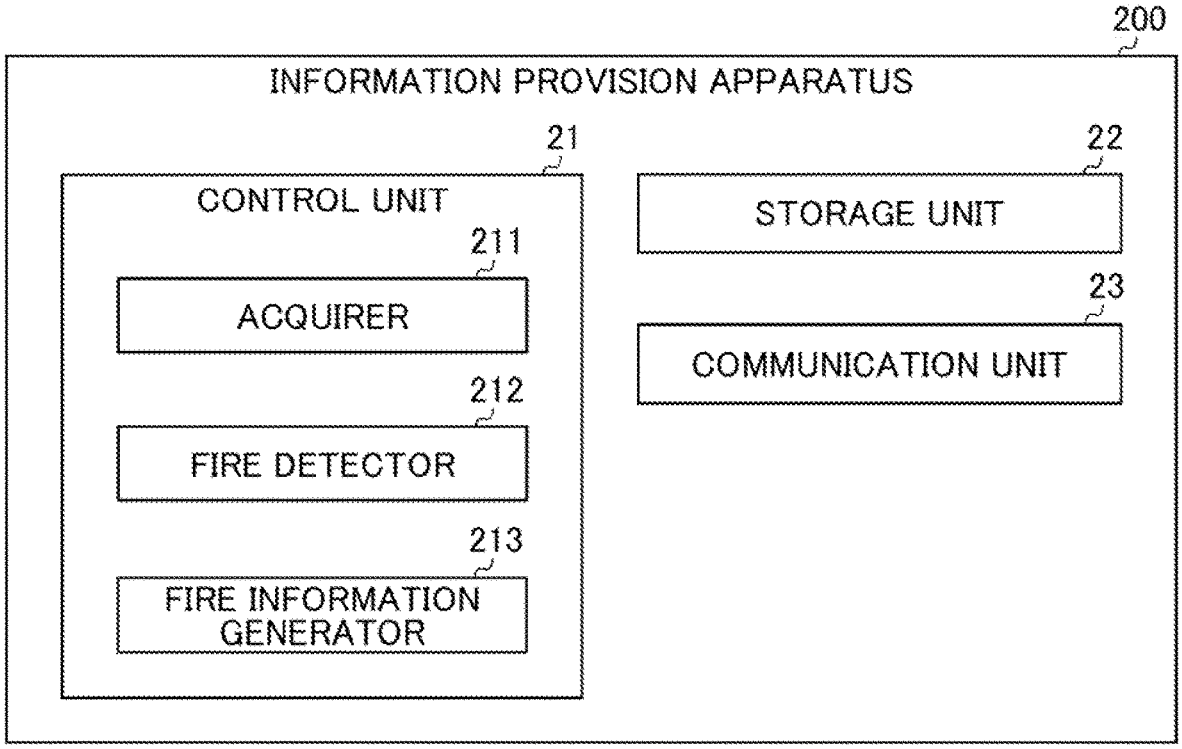
FIG. 4 is a diagram showing an example of a configuration of an information provision apparatus.

FIG. 4 is a diagram showing an example of a configuration of the information provision apparatus 200. As shown in FIG. 4, the information provision apparatus 200 includes a control unit 210, a storage unit 220, and a communication unit 230. Functions of the control unit 210 are performed by a processor, such as a CPU, executing programs (software) stored in a storage device. Part of or all of these functional components may be implemented by hardware, such as a LSI, an ASIC, and a FPGA, or by cooperation between software and hardware.

The storage unit 220 is implemented by a storage device including a non-transitory storage medium, such as a HDD, a flash memory, an EEPROM, and a ROM. Alternatively, the storage unit 220 is implemented by RAM or the like. The communication unit 230 is a communication interface for communicating with other equipment via the network NW.

Next, processing performed by the control unit 210 will be described. The control unit 210 includes an acquirer 211, a fire detector 212, and a fire information generator 213.

The acquirer 211 acquires the fire-related information, which indicates information about fire. Specifically, the acquirer 211 acquires, as the fire-related information, information detected by the fire sensor 90 of the vehicle 100. Further, the acquirer 211 acquires, as the fire-related information, images captured by a camera of the vehicle 100. The acquirer 211 also acquires the fire-related information from the monitoring apparatus 300, which collects information about fire.

The fire detector 212 detects the occurrence of fire based on the fire-related information. Specifically, in a case where the fire-related information is constituted by the information detected by the fire sensor 90 of the vehicle 100, the fire detector 212 detects that fire has occurred if the information detected by the fire sensor 90 continues for a predetermined period.

In a case where the fire sensor 90 is the camera and the fire-related information is constituted by images captured by the camera, the fire detector 212 detects that, fire has occurred if the images captured by the camera include at least a certain number of fire images.

In a case where the fire sensor 90 is the flame sensor, the fire detector 212 detects that fire has occurred if a wavelength of an UV component in an emission spectrum arising from flames is continuously detected for a predetermined period. In a case where the fire sensor 90 is the temperature sensor, the fire detector 212 detects that fire has occurred if a temperature increase rate in a certain period of time is equal to or greater than a predetermined value, or if a detected temperature is equal to or higher than a predetermined value. In a case where the fire sensor 90 is the hydrogen sensor, the fire detector 212 detects a risk of fire if a detected hydrogen concentration is equal to or higher than a predetermined value. In a case where the fire sensor 90 is the $CO_2$ sensor, the fire detector 212 detects that fire has occurred if a detected $CO_2$ concentration is equal to or higher than a predetermined value.

In a case where the fire-related information is constituted by information acquired by the monitoring apparatus 300, the fire detector 212 detects the occurrence of fire based on the fire-related information. For example, in a case where the fire-related information is constituted by images captured by the security camera 300A, the fire detector 212 detects that fire has occurred if the images captured by the security camera 300A include a fire image. In a case where the fire-related information is constituted by fire alarm information provided by the fire alarm 300B, the fire detector 212 detects that fire has occurred upon receipt of the fire alarm information provided by the fire alarm 300B. In a case where the fire-related information is constituted by fire alarm information provided by the fire station 300C, the fire detector 212 detects that fire has occurred upon receipt of the fire alarm information provided by the fire station 300C.

When the fire detector 212 detects the occurrence of fire, the fire information generator 213 generates the fire avoidance information for avoiding the fire, and transmits the fire avoidance information to the vehicle 100. As described above, the fire avoidance information includes the position information of the location of the fire, the detour information for going around the location of the fire, the information indicating the scale of the fire, etc.

Figure 5:
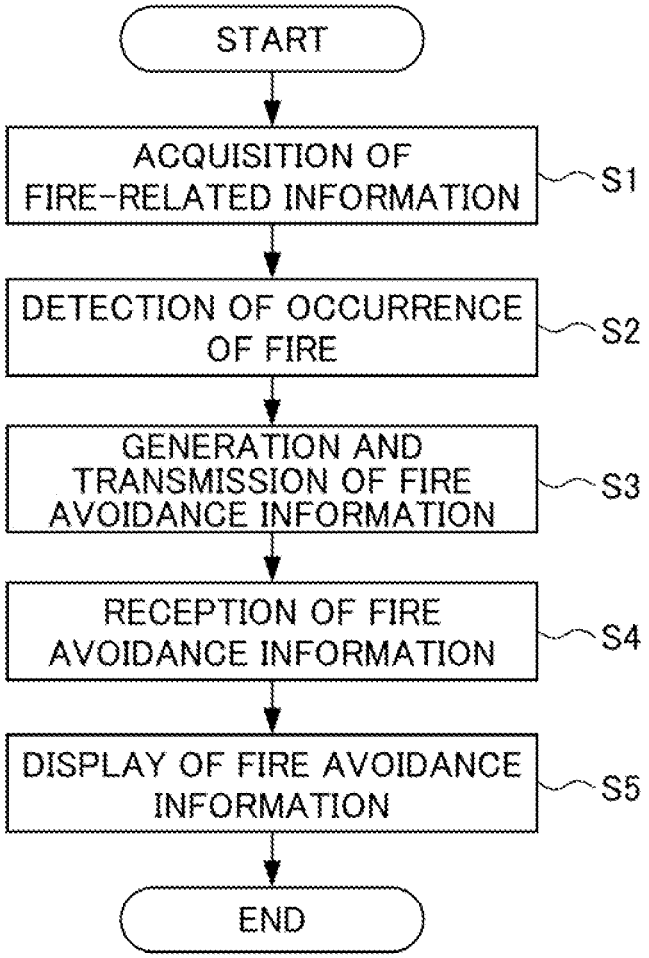
FIG. 5 is a flowchart showing processing performed by the information provision system.

FIG. 5 is a flowchart showing processing performed by the information provision system 1. In Step S1, the acquirer 211 acquires the fire-related information indicating information about fire. In Step S2, the fire detector 212 detects the occurrence of fire based on the fire-related information.

In Step S3, in response to the detection of the occurrence of fire by the fire detector 212, the fire information generator 213 generates the fire avoidance information for avoiding the fire, and transmits the fire avoidance information to the vehicle 100. In Step S4, the information receiver 611 receives the fire avoidance information transmitted from the information provision apparatus 200.

In step S5, the display controller 613 causes the display 6A to display the fire avoidance information received by the information receiver 611.

The present embodiment exerts the following effects, for example. The information provision system 1 includes the vehicle 100, and the information provision apparatus 200 that is communicatively connected to the vehicle 100 and configured to provide information to the vehicle 100. The information provision apparatus 200 has the acquirer 211 that acquires the fire-related information indicating information about fire, the fire detector 212 that detects the occurrence of fire based on the fire-related information, and the fire information generator 213 that generates, in response to the detection of the occurrence of fire by the fire detector 212, the fire avoidance information for avoiding the fire, and transmits the fire avoidance information to the vehicle 100. The vehicle 100 has the information receiver 611 that receives the fire avoidance information, and the display controller 613 that causes the display 64 to display the fire avoidance information.

Thus, the information provision system 1 can detect the occurrence of fire, and display the fire avoidance information for avoiding the fire, on the display 64 of the vehicle 100. As a result, the vehicle 100 can avoid going to the location of the fire, based on the fire avoidance information. This feature makes it possible to reduce secondary damage in the case of a disaster such as fire.

The fire-related information is also transmitted from the monitoring apparatus 300, which is communicatively connected to the information provision apparatus 200 and collects information about fire. With this feature, the information provision system 1 can suitably collect information about fire.

The vehicle 100 has the fire sensor 90 that detects a predetermined physical quantity related to fire. The acquirer 211 acquires the information detected by the fire sensor 90 as the fire-related information. With this feature, the Information provision system 1 can satisfactorily detect the occurrence of fire.

The fire sensor 90 includes the flame sensor capable of detecting a specific wavelength in an emission spectrum arising from flames. Thus, the information provision system 1 can highly accurately detect the occurrence of fire by means of the flame sensor.

The fire sensor 90 includes the camera, the temperature sensor, the hydrogen sensor, or the $CO_2$ sensor. With this feature, the information provision system 1 can detect the occurrence of fire or a risk of fire by means of an image related to fire, a temperature, a hydrogen concentration, or a $CO_2$ concentration.

One embodiment of the present invention has been described in the foregoing. However, the present invention is not limited to the embodiment described above. Appropriate modifications may be made to the specifics of the present invention, without deviating from the spirit of the present invention. For example, the vehicle 100 may control the running thereof so as not to head for the location of the fire, based on the fire avoidance information. Based on the fire-related information and the fire avoidance information, the information provision apparatus 200 may cause traffic lights to turn red on the road to the location of the fire, thereby restricting the passage of the vehicle 100.

EXPLANATION OF REFERENCE NUMERALS

1: Information Provision System
60: Display Unit
61: Control Unit
62: Storage Unit
63: Communication Unit
64: Display
65: Operation Portion
100: Vehicle
200: Information Provision Apparatus
211: Acquirer
212: Fire Detector
213: Fire Information Generator
300: Monitoring Apparatus
611: Information Receiver
612: Information Transmitter
613: Display Controller

What is claimed is:

1. An information provision system comprising: a vehicle; and an information provision apparatus communicatively connected to the vehicle and configured to provide information to the vehicle, the information provision apparatus including an acquirer that acquires fire-related information indicating information about fire, a fire detector that detects an occurrence of fire based on the fire-related information, and a fire information generator that generates, in response to the detection of the occurrence of fire by the fire detector, fire avoidance information for avoiding the fire, and transmits the fire avoidance information to the vehicle, and the vehicle including an information receiver that receives the fire avoidance information, and a display controller that causes a display to display the fire avoidance information, wherein the fire avoidance information includes position information of the location of fire, detour information for going around the location of the fire, and information indicating the scale of the fire.

2. The information provision system according to claim 1, further comprising a monitoring apparatus communicatively connected to the information provision apparatus and configured to collect information about fire, wherein the fire-related information is transmitted from the monitoring apparatus.

3. The information provision system according to claim 1, wherein the vehicle further includes a fire sensor that detects a predetermined physical quantity related to fire, and wherein the acquirer acquires information detected by the fire sensor as the fire-related information.

4. The information provision system according to claim 3, wherein the vehicle further includes a hydrogen fuel cell, wherein the fire sensor includes a hydrogen sensor that detects a concentration of hydrogen leaking from the hydrogen fuel cell and being likely to cause a fire, and wherein the fire detector detects a risk of fire if a detected hydrogen concentration is equal to or higher than a predetermined value.

5. The information provision system according to claim 3, wherein the fire sensor includes a $CO_2$ sensor that detects a concentration of $CO_2$ emitted due to the occurrence of fire, and wherein the fire detector detects that fire has occurred if a detected $CO_2$ concentration is equal to or higher than a predetermined value.

* * * * *